United States Patent [19]

Kataoka et al.

[11] Patent Number: 5,062,622

[45] Date of Patent: Nov. 5, 1991

[54] VIBRATORY SHEET FEEDER WHICH USES PHASE ADJUSTMENT TO CONTROL THE SHEET FEEDING SPEED

[75] Inventors: Kenichi Kataoka; Yoshifumi Nishimoto, both of Yokohama; Masahiko Igaki, Tokyo, all of Japan

[73] Assignee: Canon Kabushiki Kaisha, Tokyo, Japan

[21] Appl. No.: 466,952

[22] Filed: Jan. 18, 1990

[30] Foreign Application Priority Data

Jan. 19, 1989 [JP] Japan ..... 1-10380
Feb. 23, 1989 [JP] Japan ..... 1-44002

[51] Int. Cl.[5] ..... B65H 5/00

[52] U.S. Cl. ..... 271/270; 271/8.1; 271/267; 310/323

[58] Field of Search ..... 198/630; 271/8.1, 84, 271/193, 267, 270, 278, 306; 310/323

[56] References Cited

U.S. PATENT DOCUMENTS

| | | | |
|---|---|---|---|
| 4,672,256 | 6/1987 | Okuno et al. | 310/323 |
| 4,692,650 | 9/1987 | Okumura et al. | 310/323 |
| 4,692,651 | 9/1987 | Hiramatsu et al. | 310/323 |
| 4,692,652 | 9/1987 | Seki et al. | 310/323 |
| 4,752,711 | 6/1988 | Tsukimoto et al. | 310/323 |
| 4,763,776 | 8/1988 | Okumura et al. | 198/630 |
| 4,912,351 | 3/1990 | Takata et al. | 310/323 |
| 4,955,598 | 9/1990 | Hiroshige et al. | 271/267 |
| 4,997,177 | 3/1991 | Mori et al. | 271/267 |

FOREIGN PATENT DOCUMENTS

| | | | |
|---|---|---|---|
| 177243 | 6/1984 | Japan | 271/264 |
| 2636 | 1/1986 | Japan | 271/306 |
| 51429 | 3/1986 | Japan | 271/270 |
| 86333 | 5/1986 | Japan | 271/193 |
| 124412 | 6/1986 | Japan | 198/630 |
| 249845 | 10/1987 | Japan | 271/270 |
| 176232 | 7/1988 | Japan | 271/270 |
| 60532 | 3/1989 | Japan | 271/278 |
| 122846 | 5/1989 | Japan | 271/193 |
| 129784 | 5/1989 | Japan | 310/323 |
| 818989 | 4/1981 | U.S.S.R. | 198/630 |

*Primary Examiner*—Dayoan D. Glenn
*Assistant Examiner*—Steve Reiss
*Attorney, Agent, or Firm*—Fitzpartick, Cella, Harper & Scinto

[57] ABSTRACT

There is disclosed a sheet feeding device having a vibration member for generating vibration for feeding a sheet member. The vibration member is in frictional engagement with the sheet member, which is fed by vibration generated in the vibration member. The device further has a member for controlling the amplitude of the vibration of the vibration member according to the feeding speed of the sheet member whereby the sheet can be fed with a desired speed.

17 Claims, 8 Drawing Sheets

VIBRATORY SHEET FEEDER WHICH USES PHASE ADJUSTMENT TO CONTROL THE SHEET FEEDING SPEED

BACKGROUND OF THE INVENTION

1. Field of the Invention

The present invention relates to a sheet feeding device adapted for use in a computer, a copying machine, a printer, a facsimile apparatus, a word processor, a typewriter or the like, and more particularly to a sheet feeding device utilizing a travelling vibration wave for sheet feeding.

2. Related Background Art

A sheet feeding device utilizing travelling vibration wave is disclosed for example in the Japanese Laid-Open Patent Sho 59-177243. That sheet feeding device is provided with a pair of vibration member composed of elastic material for pinching therebetween a sheet with a suitable pressure, and it advances said pinched sheet by generating travelling vibration waves in said vibration members. Two groups of electromechanical energy conversion elements such as piezoelectric elements are adhered or maintained in contact with each vibration member in such a manner that the distance between said groups is equal to an odd multiple of $\lambda/4$, and, in each group, the piezoelectric element are arranged with a pitch of $\lambda/2$ and with alternating expansion-shrinkage characteristic. One of said groups of piezoelectric elements on each vibration member is given an AC electric field of a frequency close to the natural frequency of the vibration members (in practice said frequency is selected as the natural frequency of one of the vibration members) while the other group is given the same AC electric field with a phase difference of $\pi/2$ obtained by a $\pi/2$ phase shifter, thereby generating, in the vibration members, travelling vibration waves symmetrically to the feeding plane of the sheet. Said travelling vibration wave causes a kind of oval movement on a surface of the vibration member opposite to the surface where the piezoelectric elements are present. Thus mutually opposed points of the vibration members execute oval movement symmetrically to the feeding plane of the sheet, whereby the sheet is advanced by friction.

FIG. 4 schematically shows the principle of sheet feeding by the travelling vibration waves, wherein vibration members 1 and 5 support a sheet 9 with a suitable pressure, and travelling vibration waves are generated in said vibration members 1, 5. In this state, each particular point on the surface of the vibration member 1 or 5 moves along an elliptic trajectory. A point on the surface of the vibration member 1 moves clockwise along the elliptic trajectory in case the travelling vibration wave moves to right as indicated by a thick arrow. As the travelling vibration waves generated in the vibration members 1, 5 are designed to have a spatial phase difference of 180°, the peak portions, facing the sheet, of the travelling vibration waves of the vibration members proceed always in mutually opposed manner. Since the peak portions of the vibration members 1, 5 move in a direction opposite to the proceeding direction of the vibrations, there is generated a sheet feeding force in a direction indicated by a thin arrow. In the bottom portions of the vibrations, there is generated a sheet feeding force in a direction the same as said proceeding direction, but said force is smaller than in the peak portions because the lower pressure in such bottom portions results in a lower friction between the sheet and the vibration members. Consequently, the sheet feeding force in total appears in the direction opposite to the proceeding direction of the travelling vibration waves.

However such sheet feeding device, in which the travelling vibration waves are generated in the vibration members with a constant AC voltage, has been associated with a drawback of fluctuation in the sheet moving speed, because a fluctuation in the load resulting for example from unevenness in the sheet thickness varies the amplitude of the travelling vibration wave.

SUMMARY OF THE INVENTION

In consideration of the foregoing, an object of the present invention is to provide a sheet feeding device capable of stable sheet feeding even in the presence of unevenness in the sheet thickness.

Another object of the present invention is to provide a sheet feeding device capable of stable sheet feeding even at a low speed.

Still another object of the present invention is to provide a sheet feeding device capable of sheet feeding with a large amplitude even in a low speed range.

Still other objects of the present invention will become fully apparent from the following description of the embodiments.

The foregoing objects can be attained, according to the present invention, by a sheet feeding device having a pair of vibration members composed of an elastic material for supporting therebetween a sheet to be fed, and two groups of electromechanical energy converting elements adhered to each vibration member in such a manner that said elements in each group are arranged with a pitch of $\lambda/2$ and with alternating expansion-shrinkage characteristic and that said two groups on each vibration member are mutually distanced by an odd multiple of $\lambda/4$, in which two AC voltages of a phase difference of 90° in time are respectively supplied to said two groups of the electromechanical converting elements on each vibration member to generate a travelling vibration wave of a wavelength $\lambda$ in each vibration member by the synthesis of two standing waves of a wavelength $\lambda$, generated by said groups with a mutual phase difference of $\lambda/4$, thereby feeding the sheet supported between said vibration members in a direction opposite to the proceeding direction of said travelling vibration wave, comprising:

vibration state detecting means for respectively detecting the vibration state of said two vibration members; and control means for comparing the amplitude information from said vibration state detecting means with that corresponding to an arbitrarily selected sheet feeding speed, and controlling each group of electromechanical converting elements in such a manner that each vibration member vibrates with an amplitude corresponding to the arbitrarily selected sheet feeding speed.

DESCRIPTION OF THE PREFERRED EMBODIMENTS

(First Embodiment)

Figure 1:
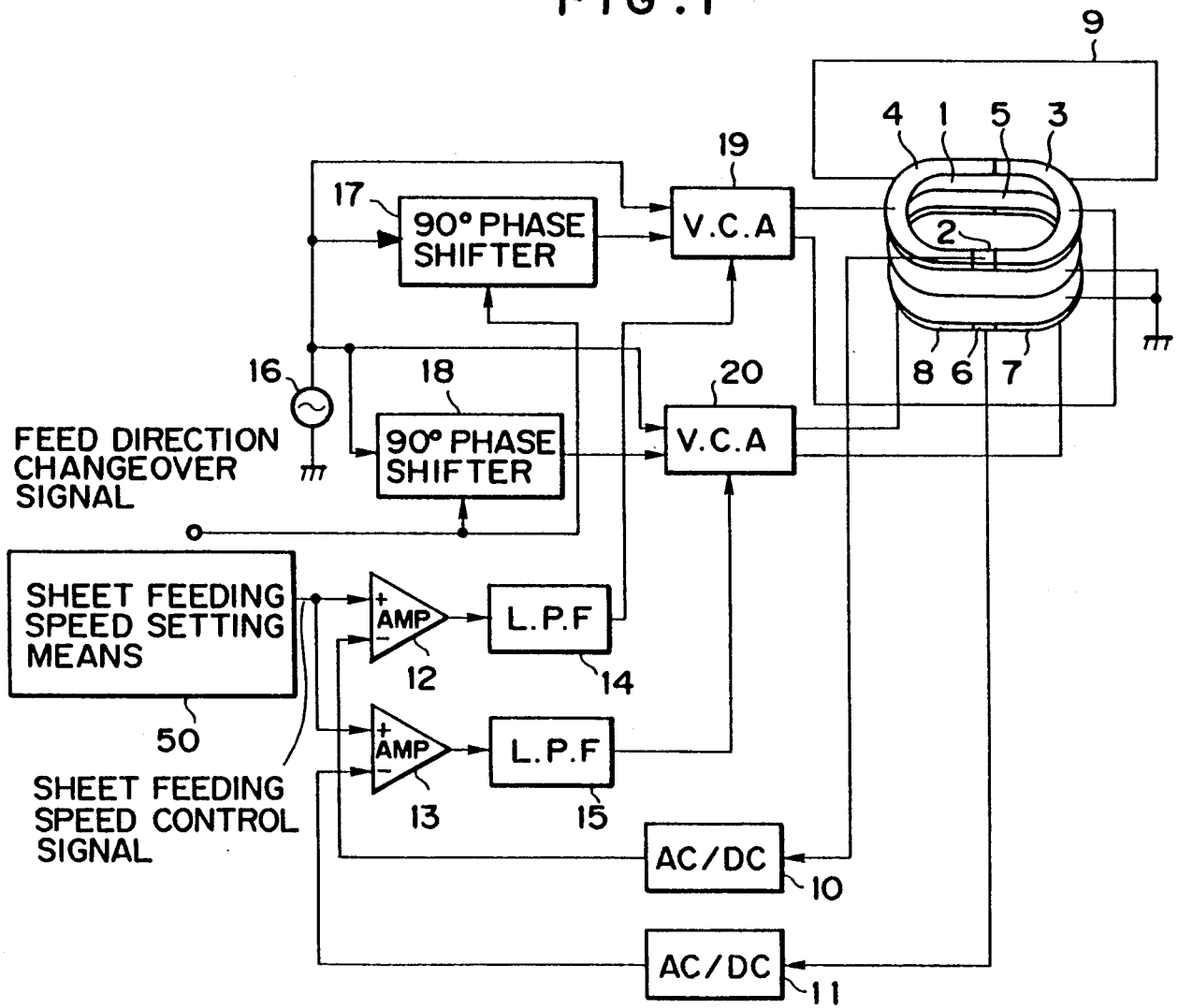
FIG. 1 is a schematic block diagram of a first embodiment of the sheet feeding device of the present invention.

FIG. 1 is a schematic block diagram of a first embodiment of the sheet feeding device of the present invention.

Metallic vibration members (first and second vibration members) 1, 5 of a certain thickness formed in an elongated circular shape pinch, in one of the linear portions of said members, a sheet 9 such as paper or film with a suitable pressure. On the mutually distant faces, there are provided two groups of piezoelectric element regions 3, 4 and 7, 8 serving as electromechanical energy converting elements for generating in each vibration member two standing waves which are mutually aberrated by $\lambda/4$ in position ( $\lambda$ being wavelength) and by 90° in time thereby synthesizing a travelling vibration wave, and detecting piezoelectric elements 2, 6 for detecting the state of travelling vibration waves respectively formed on the vibration members 1, 5. The first and second vibration members 1, 5 are electrically maintained at the ground potential.

There are further provided a first AC/DC converter 10 and a second AC/DC converter 11 for detecting the amplitude (peak value, effective value, average value etc.) of the output signals of the detecting piezoelectric elements 2, 6, a first differential amplifier 12 and a second differential amplifier 13. The first differential amplifier 12 releases an output signal by subtracting the output signal of the first AC/DC converter 10 from a sheet feed speed control signal selected by a sheet feed speed setter 50, while the second differential amplifier 13 releases an output signal obtained by subtracting the output of the second AC/DC converter 11 from said sheet feed speed control signal.

A first low-pass filter (LPF) 14 is provided for amplifying and integrating the output signal of the first differential amplifier 12, while a second low-pass filter (LPF) 15 is provided for amplifying and integrating the output of the second differential amplifier 13.

There are further provided an oscillator 16 for generating a basic reference signal for AC voltages to be supplied to the piezoelectric element regions 3, 4, 7, 8 for forming travelling vibration waves in the first and second vibration members 1, 5; and first and second 90° phase shifters 17, 18 for shifting the phase of the basic reference signal of the oscillator 16 by +90° or −90° in response to a feed direction switching signal from feed direction setting means (not shown). The first 90° phase shifter 17 generates a phase difference of 90° in time between the piezoelectric element regions 3 and 4, while the second 90° phase shifter 18 generates a phase difference of 90° in time between the regions 7 and 8, thereby forming the travelling vibration waves in the first and second vibration members 1 and 5. First and second voltage-controlled amplifiers 19, 20 are provided for varying the amplitude of the output of the oscillator 16 and that of the first and second 90° phase shifters 17, 18, in response to the output signals of the first and second low-pass filters 14, 15.

The sheet feeding device of the present embodiment explained above functions in such a manner that the amplitudes of travelling vibration waves formed on the first and second vibration members 1, 5 respectively correspond to the sheet feed speed control signal.

More specifically, if the amplitude of the travelling vibration wave formed on the first vibration member 1 becomes smaller than the amplitude corresponding to the sheet feed speed control signal in the course of sheet feeding, for example due to the influence of unevenness in the sheet thickness, thereby reducing the sheet feeding speed, the DC voltage corresponding to the amplitude of the travelling vibration wave on the first vibration member 1, obtained by the first AC/DC converter 10 based on the output signal of the detecting piezoelectric element 2, becomes smaller than the sheet feed speed control signal, whereby the first differential amplifier 12 becomes a positive state. In response the output voltage of the first low-pass filter 14 increases to elevate the amplification factor of the first voltage-controlled amplifier 19. Thus the AC voltages supplied to the piezoelectric element regions 3, 4 for driving the first vibration member 1 increase in amplitude to increase the amplitude of the travelling vibration wave formed on the first vibration member 1, until a value corresponding to the sheet feed speed control signal. Also on the second vibration member 5, as in the case of the first vibration member 1 explained above, the amplitude of the AC voltages supplied to the piezoelectric element regions 7, 8 for driving said second vibration member 5 are so controlled that the travelling vibration wave formed therein has an amplitude corresponding to the sheet feed speed control signal, by means of the second AC/DC converter 11, second differential amplifier 13, second low-pass filter 15 and second voltage-controlled amplifier 20.

(Second Embodiment)

Figure 2:
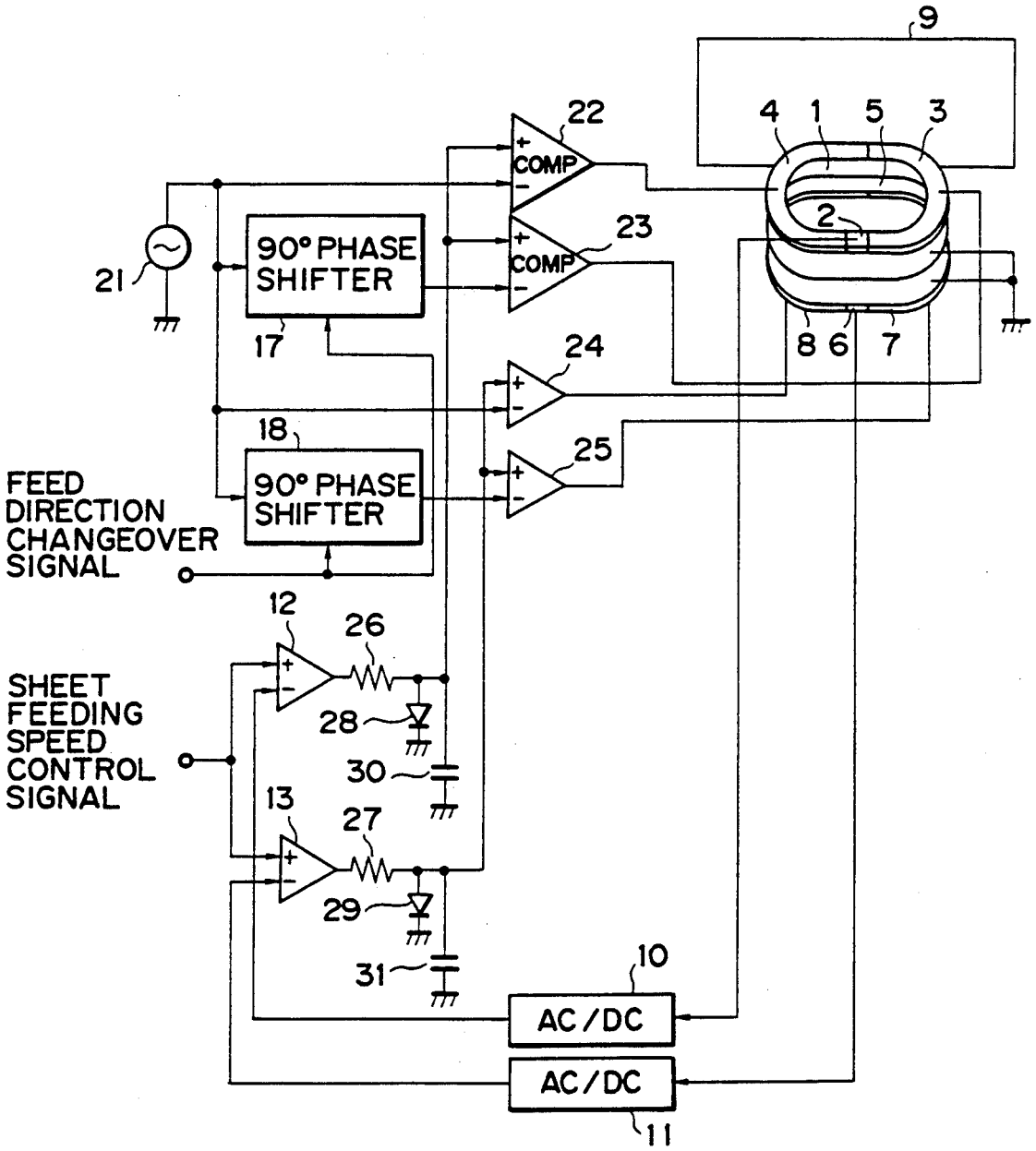
FIG. 2 is a schematic block diagram of a second embodiment.

FIG. 2 is a schematic block diagram of a second embodiment, in which same components as those in FIG. 1 are represented by same numbers and will now be explained further.

In the foregoing first embodiment, the stabilization of the sheet feeding speed is achieved by controlling the vibrations of the vibration members 1, 5 at a predetermined amplitude, through the amplitude control of the voltages supplied to the piezoelectric element regions 3, 4 of the first vibration member 1 and the regions 7, 8 of the second vibration member 5 by means of the voltage-controlled amplifiers 19, 20. In the present embodiment, the amplitude of the vibrations of the first and second vibration members 1, 5 is controlled by the pulse durations of the voltages supplied to the piezoelectric element regions 3, 4 of the first vibration member 1 and the regions 7, 8 of the second vibration member 5.

In FIG. 2, there are provided a sawtooth wave generator 21 for generating a basic reference signal for the AC voltages to be supplied to the piezoelectric element regions 3, 4, 7 and 8 for generating travelling vibration waves in the first and second vibration members 1, 5; a first pulse width controlling comparator 22 for controlling the duration of voltage pulses supplied to the region 4; a second pulse width controlling comparator 23 for controlling the duration of voltage pulses supplied to the region 4; a third pulse width controlling comparator 24 for controlling the duration of voltage pulses supplied to the region 8; and a fourth pulse width controlling comparator 25 for controlling the duration of voltage pulses supplied to the region 7. The first and second comparators 22, 23 receive, at the positive input terminals thereof, a signal from a first positive output clipping low-pass filter consisting of a resistor 26, a diode 28 and a capacitor 30 for clipping the positive output, while the third and fourth comparators 24, 25 receive, at the positive input terminals thereof, a signal from a second positive output clipping low-pass filter consisting of a resistor 27, a diode 29 and a capacitor 31 for clipping the positive output. The output signal of the first low-pass filter 12 is supplied to said first positive output clipping low-pass filter, while that of the second low-pass filter 13 is supplied to said second positive output clipping filter.

In the sheet feeding device of the present embodiment explained above, if the amplitude of the travelling vibration wave formed on the first vibration member 1 becomes, for example, smaller than the amplitude corresponding to the sheet feeding speed control signal, the DC voltage corresponding to the amplitude of said travelling vibration wave on the first vibration member 1, obtained from the first AC/DC converter 10 based on the output signal of the detecting piezoelectric element 2, becomes smaller than said sheet feed speed control signal, whereby the first differential amplifier 12 releases a positive output signal. In response the output signal of said first positive output clipping low-pass filter increases toward 0 (V) to increase the duration of the pulses generated from the first and second pulse width controlling comparators 22, 23. Consequently the amplitude of the travelling vibration wave formed on the first vibration member 1 is increased, and the pulse duration of the AC voltages supplied to the regions 3, 4 is so controlled as to bring said amplitude to a value corresponding to the sheet feed speed control signal.

The output signals of the first and second pulse width controlling comparators 22, 23 assume a potential Vcc (V) if the positive input is larger, or 0 (V) if the negative input is larger, and Vcc is selected large enough, not causing the clipping of the output of said first positive output clipping low-pass filter.

Also with respect to the second vibration member 5, as in the case of the first vibration member 1 explained above, the pulse duration of the AC voltages supplied to the piezoelectric element regions 7, 8 is so controlled that the travelling vibration wave formed on the second vibration member 5 has an amplitude corresponding to the sheet feed speed control signal, by means of the second AC/DC converter 11, second differential amplifier 13, third pulse duration controlling comparator 24, fourth pulse width controlling comparator 25 and said second positive output clipping low-pass filter.

Figure 3:
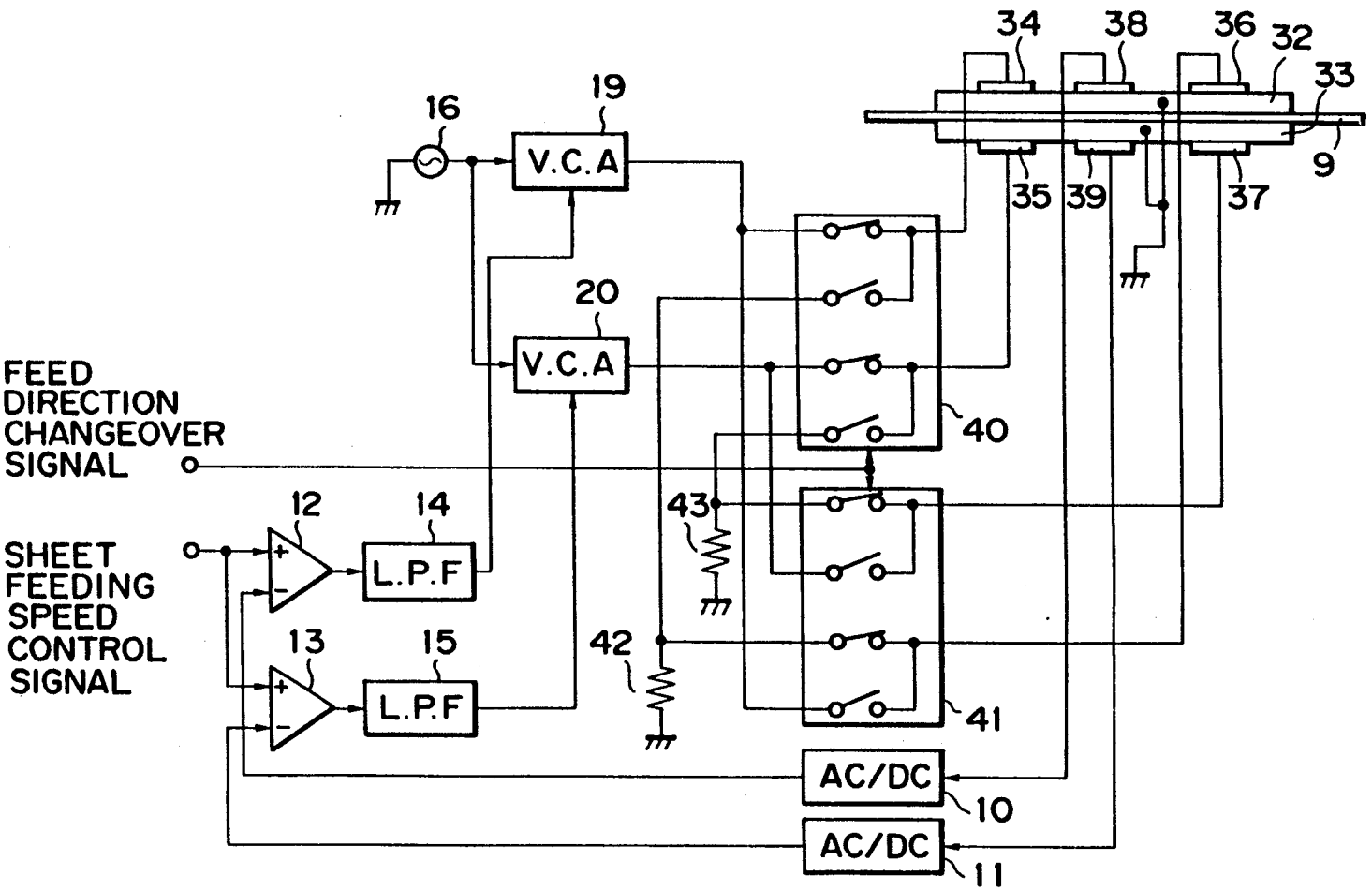
FIG. 3 is a schematic block diagram of a third embodiment.
Figure 4:
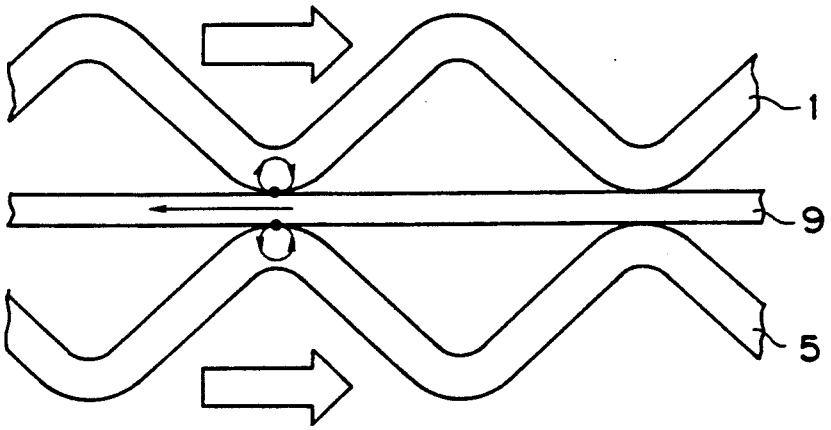
FIG. 4 is a view showing the working principle of the sheet feeding device.

(Third Embodiment,

FIG. 3 is a schematic block diagram of a third embodiment, wherein same components as those in FIG. 1 are represented by same numbers and will not be explained further.

The foregoing first and second embodiments employ vibration members of an elongated circular shape, but the present third embodiment employs vibration members of a plate shape with two ends.

In the foregoing embodiments, AC voltages are supplied to two piezoelectric element regions provided in the vibration member and a travelling vibration wave is generated by the synthesis of standing waves generated by the vibration in said regions, but it is also possible to generate the travelling vibration wave in the vibration member in the following manner.

Figure 5:
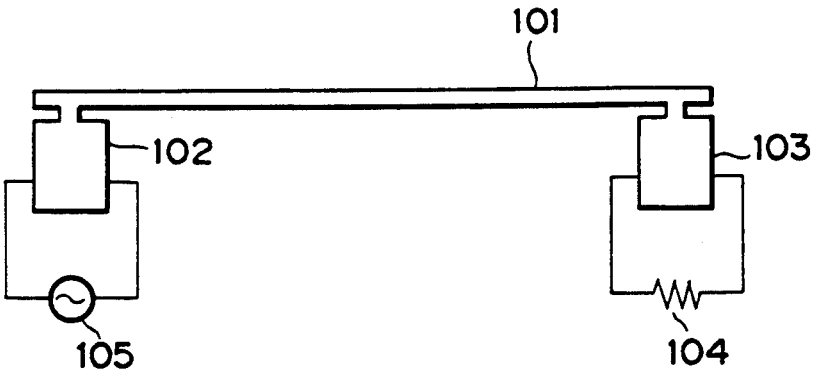
FIG. 5 is a view showing the driving principle of the third embodiment.

In this method, as shown in FIG. 5, the vibration member 101 is provided with a driving vibrator 102 for causing vibration in said vibration member 101 by means of an oscillator 105, and a matching vibrator 103. The voltage generated in said vibrator 103 is shortcircuited by an ending resistor 104 whereby the vibration energy is converted into electrical energy which is consumed in said ending resistor 104. Thus the energy emitted from the driving vibrator 102 flows in one direction to generate a travelling vibration wave on the vibration member 101.

When the vibrator 102 is activated by the oscillator 105, the generated vibration wave propagates to right along the vibration member 101. In the absence of matching vibrator 103 and resistor 104, the wave is reflected at the right-hand end of the vibration member 101 and is transmitted again toward left, and a standing wave is formed on the vibration member 101 if the frequency of vibration is the natural frequency of the vibration member 101. However, in the presence of the matching vibrator 103 and resistor 104, the energy of the vibration wave is dissipated in said resistor 104, so that a wave travelling from left to right is formed on the vibration member 101.

The present embodiment utilizes such principle of travelling wave generation. Referring to FIG. 3, there are provided first and second plate-shaped vibration members 32, 33 maintained electrically at the ground potential and supporting the sheet 9; piezoelectric elements 34, 36, 35 and 37 mounted on end portions of the first and second plate-shaped vibration members 32, 33 for generating and absorbing vibration; detecting piezoelectric elements 38, 39 for detecting the vibration state of said first and second vibration members 32, 33; analog switches 40, 41 for selecting either of the elements 34, 35 and elements 36, 37 for generating vibration and the other for absorbing vibration according to a feed direction switching signal; and vibration absorbing resistors 42, 43. The analog switches 40, 41 assume at the low-level state, and are switched to the other state, namely from open to closed state and closed to open state, when said switching signal is at the high-level state.

The output of the detecting piezoelectric element 38, for detecting the vibration state of the first vibration member 32, is converted into a DC signal by the first AC/DC converter 10 and is supplied to the first differential amplifier 12, while the output of the detecting piezoelectric element 39, for detecting the vibration state of the second vibration member 33, is converted into a DC signal by the second AC/DC converter 11 and is supplied to the second differential amplifier 13. The first and second differential amplifiers 12, 13 control the first and second voltage-controlled amplifiers 19, 20 through the first and second low-pass filters 14, 15 according to the differences from the sheet feed speed control signal supplied to said differential amplifiers, thereby controlling the amplitude of the voltages supplied from the oscillator 16 to the piezoelectric elements 34, 35, 36, 37.

Therefore, in the present embodiment, as in the foregoing embodiments, if the amplitude of the travelling vibration wave for example in the second vibration member 33 becomes smaller, in the course of sheet feeding, than the value corresponding to the sheet feed speed control signal, the second voltage-controlled amplifier 20 controls the piezoelectric element 35 or 37 selected by the analog switches 40, 41, in such a manner that said amplitude becomes equal to said value corresponding to the control signal.

Consequently the sheet can be always fed with a constant speed as in the foregoing embodiments.

In the foregoing embodiments, the fluctuation in the sheet feeding speed, resulting, for example, from unevenness in sheet thickness, is compensated for by the control of amplitude of vibration members, but stable feeding cannot be obtained by this method alone if the feeding speed is low.

The following embodiments shown in FIG. 6 and ensuing drawings are to solve such drawback, as will be explained in the following.

Figure 6:
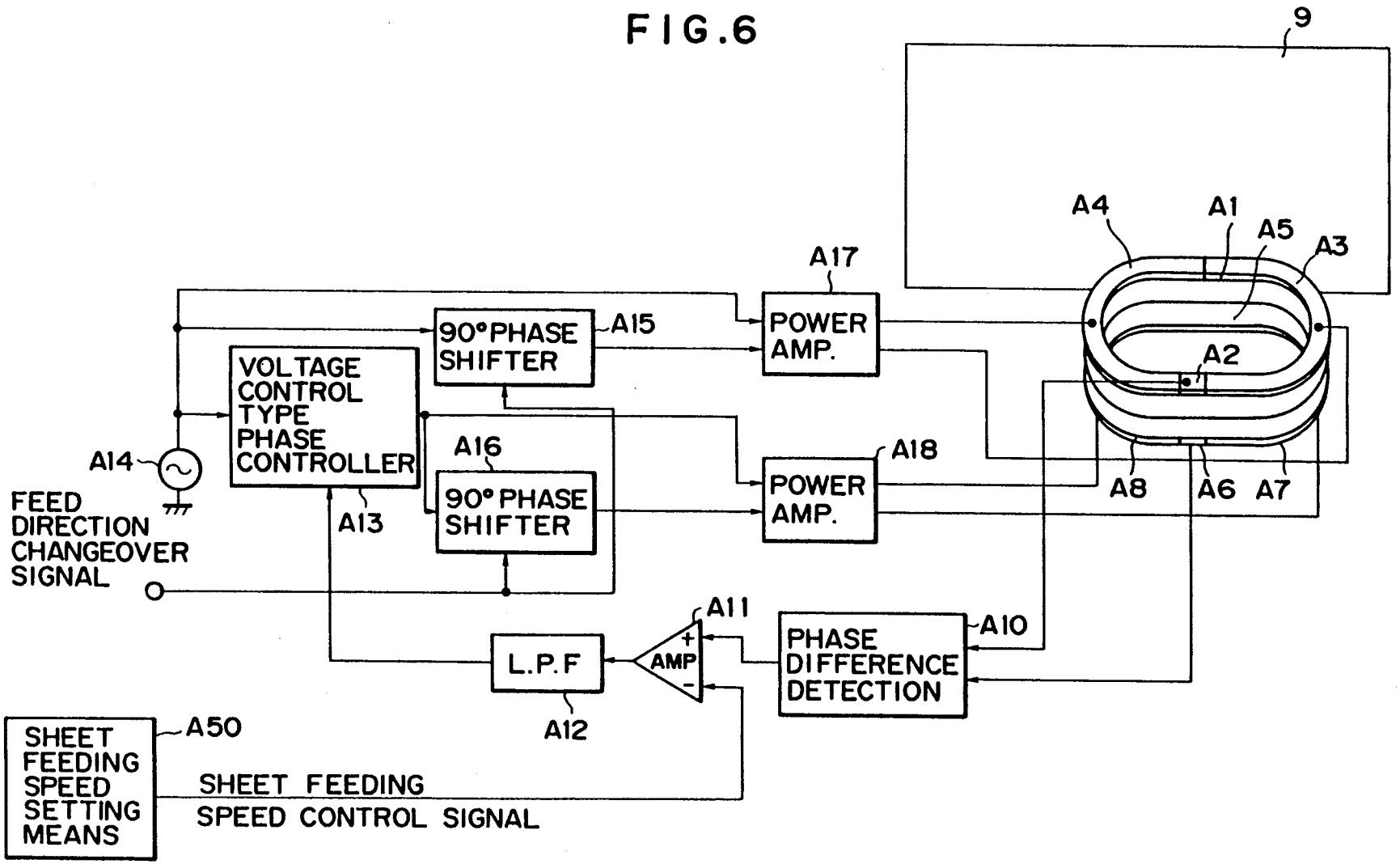
FIG. 6 is a schematic block diagram of a fourth embodiment.

FIG. 6 is a schematic block diagram of a fourth embodiment of the sheet feeding device of the present invention.

Metallic vibration members (first and second vibration members) A1, A5 of a certain thickness formed in an elongated circular shape, as in FIG. 1, pinch a sheet 9 such as paper or film with a suitable pressure, in one of the linear portions of said members. On the mutually distant faces, there are provided two groups of piezoelectric element regions A3, A4 and A7, A8 for generating in each vibration member two standing waves which are mutually aberrated by $\lambda/4$ in position ( $\lambda$ being wavelength) and by 90° in time thereby synthesizing a travelling vibration wave, and detecting piezoelectric elements A2, A6 detecting the state of travelling vibration waves respectively formed on the vibration members A1, A5. The first and second vibration members A1, A5 are electrically maintained at the ground potential.

A phase difference detector A10 detects the phase difference in time, at a same spatial position, of the travelling vibration waves formed in the vibration members A1, A5, as the phase difference between signals from the first and second detecting piezoelectric elements A2 and A6. There are also provided a differential amplifier A11 for amplifying the difference between the phase difference detected by the phase difference detector A10 and a phase difference corresponding to a sheet feed speed control signal set by a sheet feed speed setter A50; a low-pass filter (LPF) A12 for amplifying and integrating the output signal of the differential amplifier A11; and a voltage-controlled phase shifter A13 for releasing a signal which is phase shifted from the output signal of an oscillator A14, in response to the output signal of the low-pass filter A12.

The oscillator A14 generates a basic reference signal for the AC voltages supplied to the piezoelectric element regions A3, A4, A7, A8 of the first and second vibration members A1, A5, and said signal is supplied to the regions A7, A8 of the second vibration member A5 through the voltage-controlled phase shifter A13.

A first 90° phase shifter A15 shifts the phase of the basic reference signal from the oscillator A14 by +90° or −90° in response to a feed direction switching signal from feed direction setting means (not shown), and serves to shifts the phase of driving signal for the piezoelectric element region A3 of the first vibration member 1 by 90° with respect to that of the region A4. A second 90° phase shifter A16 shifts the phase of the output signal of the voltage-controlled phase shifter A13 by +90° or −90° in response to the feed direction switching signal, and serves to shift the phase of driving signal for the region A7 of the second vibration member A5 by 90° with respect to that for the region A8. There are further provided a first power amplifier A17 for amplifying the output signals of the oscillator A14 and of the first 90° phase shifter A15 with a suitable amplification factor for supply to the piezoelectric element regions A3, A4 of the first vibration member A1; and a second power amplifier A18 for amplifying the output signals of the voltage-controlled phase shifter A13 and of the second 90° phase shifter A16 for respective supply to the regions A3, A7 of the second vibration member A5. In the embodiment shown in FIG. 6, the circuit for compensating the fluctuation in the sheet feeding speed by controlling the amplitude of vibration of the vibration members A1, A5 shown in FIG. 1 is omitted for the purpose of simplicity.

In the following there will be explained the function of the fourth embodiment explained above, with reference to a chart shown in FIG. 7.

Figure 7:
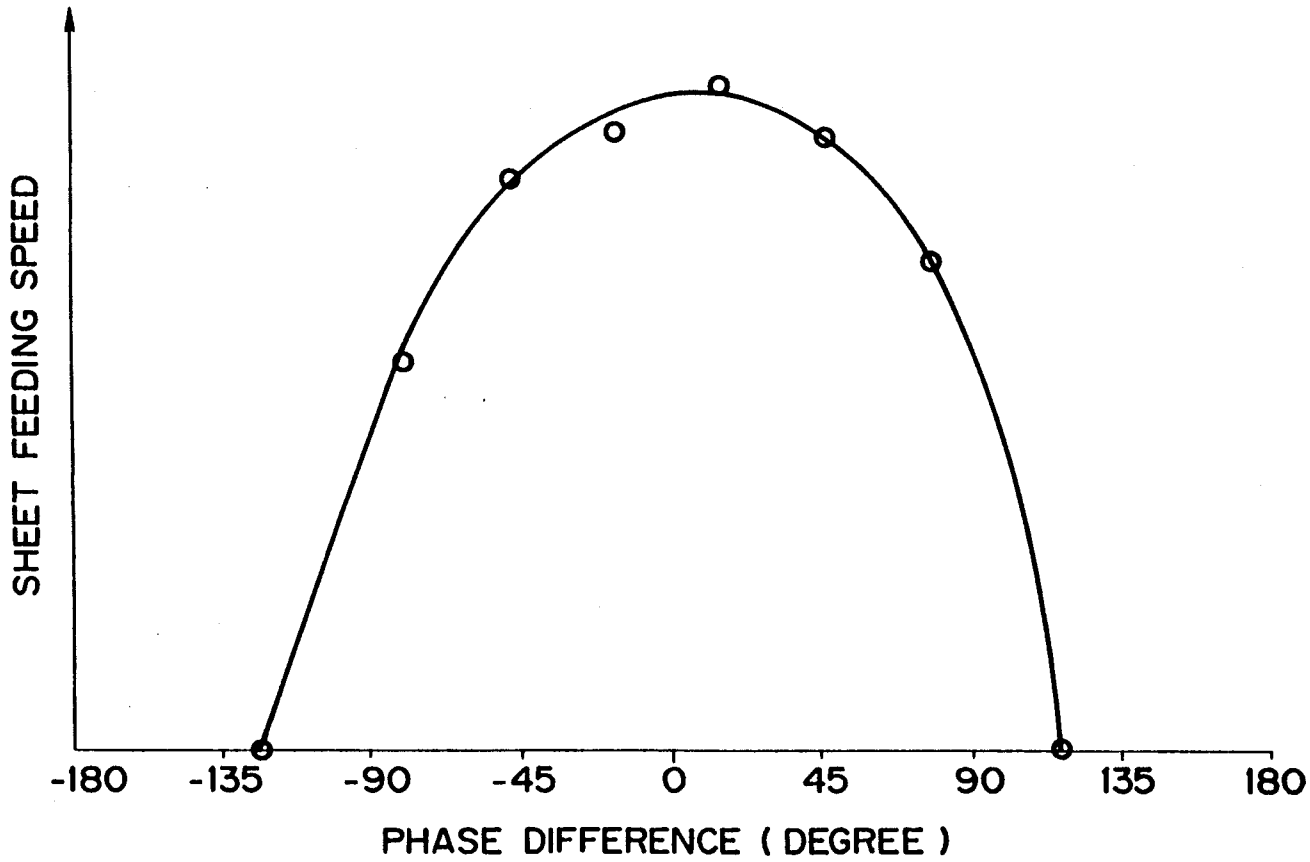
FIG. 7 is a chart showing the relation between the phase difference between the vibration waves generated on the vibration members and the sheet feeding speed.

FIG. 7 shows the relationship between the sheet feeding speed and the output of the phase difference detector A10. As shown in FIG. 7, the feeding speed is highest at zero phase difference, then monotonously decreases as the phase difference approaches to 180° and becomes zero in the vicinity of 180°.

It is now assumed that the output of the phase difference detector A10 is 0° when the sheet feed speed control signal corresponds to zero phase difference where the feeding speed is highest. If the sheet feed speed control signal is switched to a state corresponding to a phase difference of 45°, the differential amplifier A11 releases a negative output whereby the output of the low-pass filter A12 decreases. Thus the phase of the output signal of the voltage-controlled phase shifter A13 is delayed, so that the travelling vibration waves in the first vibration member A1 driven by the basic reference signal of the oscillator A14 and the second vibration member A5 driven by the output signal of the voltage-controlled phase shifter A13 have a same amplitude but become different in phase. The phases of the travelling waves in the vibration members A1, A5 are respectively detected by the first and second detecting piezoelectric elements A2, A6 and the difference in said phases is supplied to the differential amplifier A11, whereby feedback control is conducted in such a manner that the phase of the output of the first detecting piezoelectric element A2 of the first vibration member A1 is advanced by 45° with respect to that of the second detecting element A6 of the second vibration member A5, and the sheet 9 is driven in a preselected direction with a speed corresponding to the phase difference shown in FIG. 7.

(Fifth Embodiment)

Figure 8:
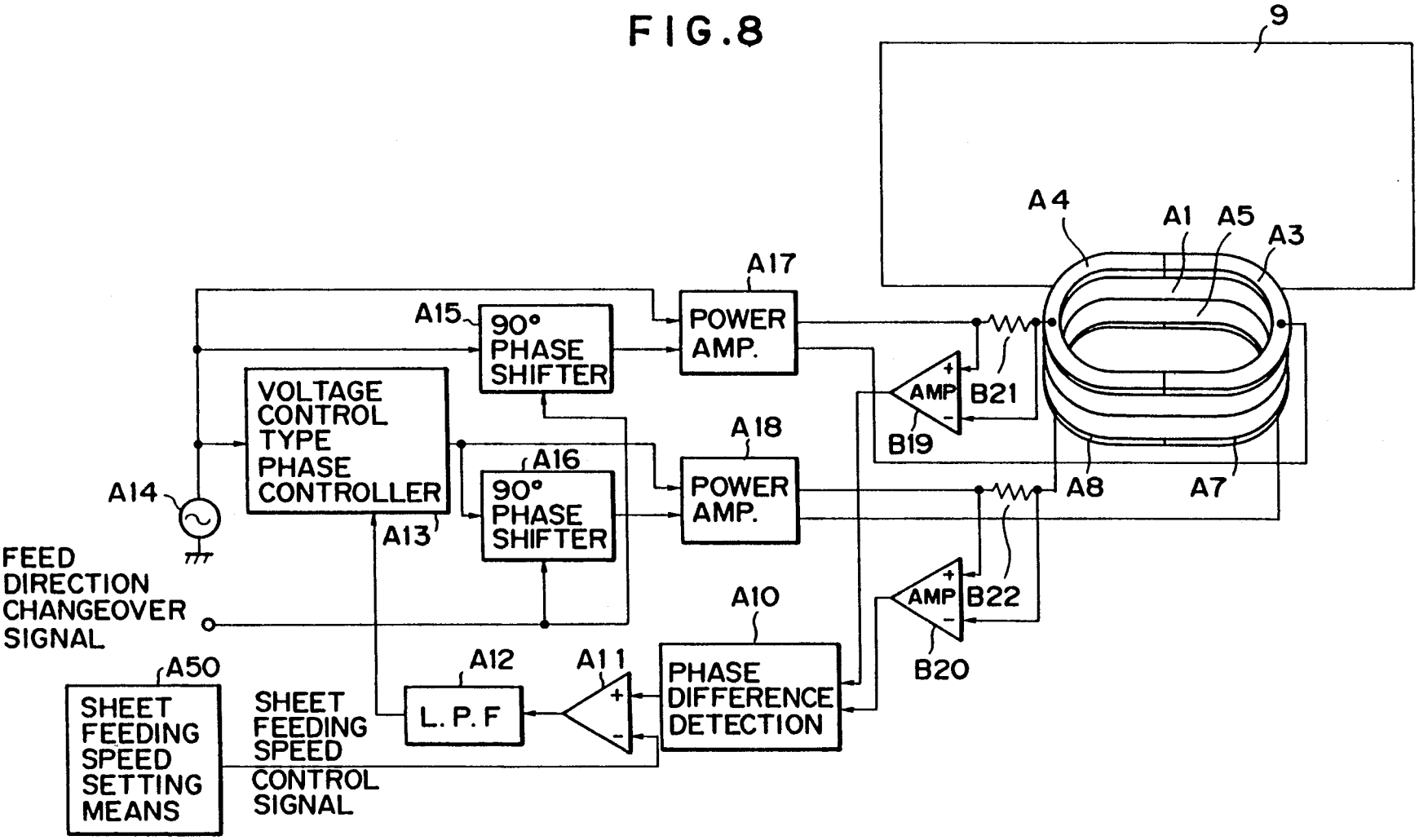
FIG. 8 is a schematic block diagram of a fifth embodiment.

In the fourth embodiment explained above, two piezoelectric elements A2, A6 for detecting the vibration are respectively provided on the vibration members A1, A5 and the control is so conducted as to maintain a constant difference between the detected phases of the vibrations. The present embodiment does not employ such detecting piezoelectric elements but detects the currents flowing into the driving piezoelectric element regions at the supply of AC voltages thereto, and the phase difference between the AC voltages supplied to the piezoelectric element regions A4 and A3 or A8 and A7 is controlled in such a manner that the currents flowing into said regions have a phase difference corresponding to the sheet feed speed control signal. The present embodiment is schematically shown in FIG. 8.

Differential amplifiers B19, B20 are provided for detecting the currents flowing into the piezoelectric element regions A4, A8 by amplifying the voltages across resistors B21, B22, and the output signals of said differential amplifiers are supplied to the phase difference detector A10. Other structures are samples as in the foregoing fourth embodiment except that the vibration members A1, A5 are not provided with the detecting piezoelectric elements, and will not, therefore, be explained.

In contrast to the foregoing fourth embodiment in which the phase detection is conducted by the output voltages of the detecting piezoelectric elements A2, A6, the present embodiment effects the phase detection by the currents flowing into the driving piezoelectric element regions A4, A8. Thus the sheet feeding speed is controlled in a similar manner as in the fourth embodiment, by detecting the phase difference between the travelling waves in the vibration members A1, A5, from the output signals of the differential amplifiers B19, B20.

(Sixth Embodiment)

In contrast to the foregoing fourth and fifth embodiments employing vibrations members of elongated circular shape, the present embodiment employs plate-shaped vibration members with two ends.

In the foregoing fourth and fifth embodiments, AC voltages are supplied to two piezoelectric element regions provided in the vibration member, and a travelling vibration wave is generated by the synthesis of standing waves generated by the vibrations in said regions, but it is also possible to generate the travelling vibration wave in the vibration member according to the principle as already explained in relation to FIG. 5.

Figure 9:
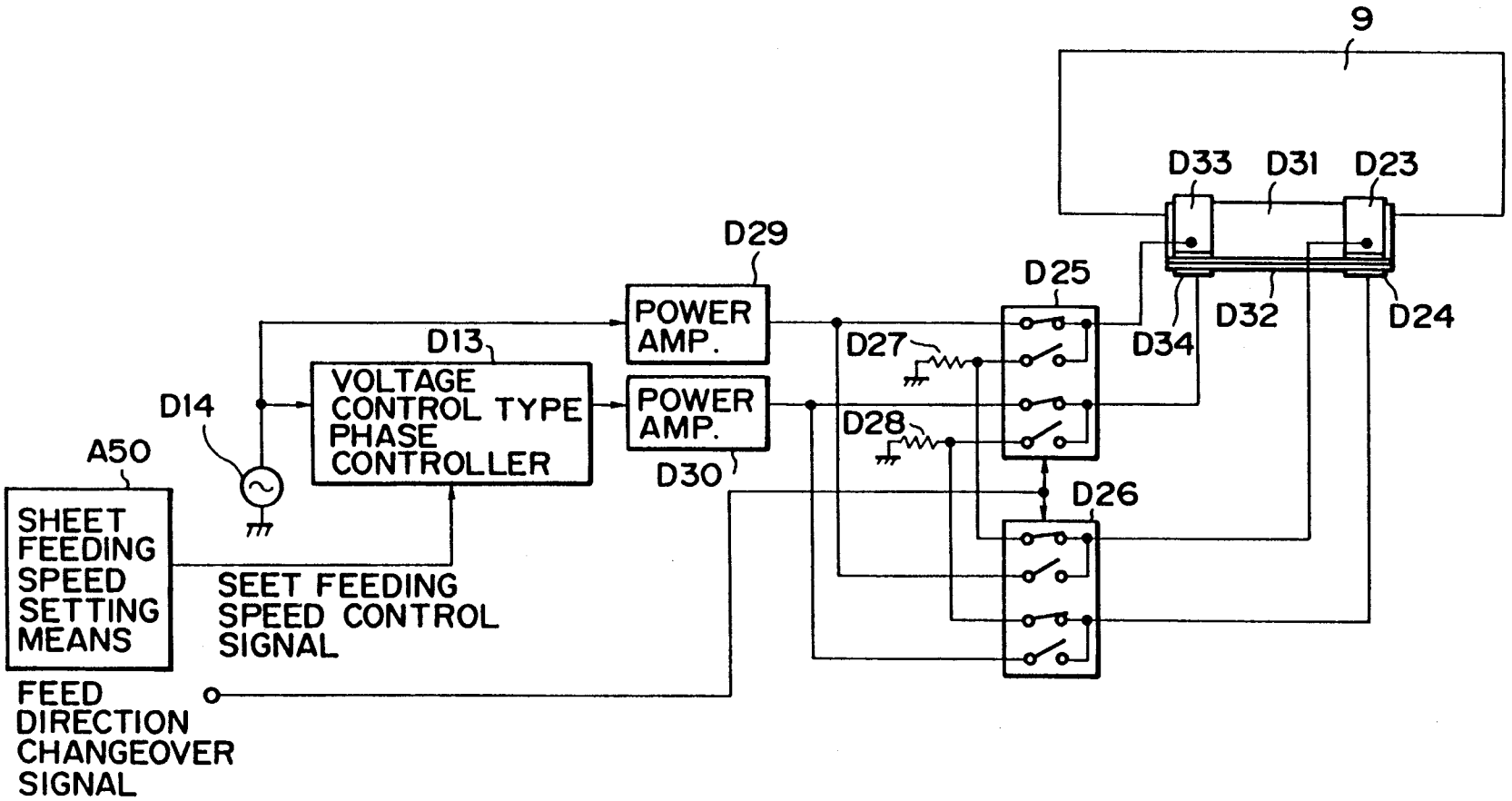
FIG. 9 is a schematic block diagram of a sixth embodiment.

The sixth embodiment utilizes such principle for generating the travelling vibration wave. In FIG. 9 there are provided vibration members D31, D32; driving piezoelectric elements D33, D34, D23, D24; analog switches D25, D25 for selecting either of said elements D33, D23 and D34, D24 for generating vibration and the other for absorbing vibration according to a feed direction switching signal; resistors D27, D28 for absorbing vibration; and power amplifiers D29, D30 for amplifying the output voltages of an oscillator D14 and a voltage-controlled phase shifter D13. In this circuit, when the sheet is moved to right in FIG. 9 in response to the feed direction switching signal, the analog switches D25, D26 are so set as to select the piezoelectric elements D33, D34 for vibration generation and the elements D23, D24 for vibration absorption, and vice versa when the sheet is moved in the opposite direction. Also a change in the sheet feed speed control signal varies the amount of phase shift of the voltage-controlled phase shifter D13. Thus the phase difference between the AC voltages supplied to the piezoelectric elements D33, D34 and D23, D24 also varies, thereby varying the phase difference between the travelling waves formed on the vibration members D31, D32, and also varying the feeding speed of the sheet.

In the foregoing embodiments, feedback control by detecting the actual feeding speed of the sheet itself and varying the sheet feed speed control signal according to thus detected speed is not employed, but it is also possible to achieve stabler speed control by detecting the sheet speed for example with a rotary encoder connected to a rubber roller maintained in contact with the sheet or with a non-contact detecting method such as a laser doppler method, and regulating the sheet feed speed control signal according to thus detected speed.

Also in the fourth to sixth embodiments, the phase difference between the vibration in the first vibration member A1 and that in the second vibration member A5 is realized by an electrical phase difference between the drive signals supplied to the piezoelectric elements, serving as the electromechanical energy converting elements, provided on the vibration members A1, A5, but it is also possible to regulate the wave form of the drive signals, instead of the phase thereof, supplied to said converting elements according to the feeding speed. More specifically, the effect of the fourth to sixth embodiments, namely of stable feeding in a low speed range can be obtained by employing a sinusoidal wave for a drive signal and a sawtooth wave for the other drive signal.

Also in the first to third embodiments there is employed a structure for pinching the sheet with two vibration members, but the present invention is likewise applicable to a sheet feeding device employing a single vibration member and effecting the sheet feeding by frictional engagement of the sheet with said vibration member.

What is claimed is:

1. A sheet feeding device comprising:

a vibration member for generating vibration for feeding a sheet member, said vibration member having first and second vibration elements provided in positions for pinching said sheet member;

means for controlling the amplitude of vibration of said vibration member, in response to a change in the feeding speed of said sheet member; and means for varying the phase difference between the vibration generated in the first vibration element and that in the second vibration element in accordance with the change in the feeding speed of the sheet member.

2. A sheet feeding device comprising:

(a) a vibration member for generating vibration for feeding a sheet member, said vibration member having first and second vibration elements provided in positions for pinching said sheet member; and (b) means for varying the phase difference between the vibration generated in the first vibration element and that in the second vibration element in accordance with a change in the feeding speed of said sheet member.

3. A sheet feeding device according to claim 2, wherein said vibration member comprises a first driving signal supply means for applying a first alternating signal to said first vibration element and a second driving signal supply means for applying a second alternating signal to said second vibration element.

4. A sheet feeding device according to claim 3, wherein said varying means detects both said first and second alternating signals and comprises an element which generates a control signal representing the phase difference between the vibration generated in the first vibration element and that generated in the second vibration element, said control signal based on the alternating signals and an element which varies the phase difference in conformity with the control signal from the generating element.

5. A sheet feeding device according to claim 2, wherein each of said first and second vibration elements include an oval-shaped vibration element.

6. A sheet feeding device according to claim 3, wherein each of said first and second vibration elements includes a straight part frictionally engaged with the sheet member in order to feed said sheet member.

7. A sheet feeding device according to claim 2, wherein said first vibration element comprises:

first and second electromechanical energy converting elements provided in spatially different positions; and a first sensor for detecting the vibration state of said first vibration element.

8. A sheet feeding device according to claim 7, wherein said second vibration element comprises:

third and fourth electromechanical energy converting elements provided in spatially different positions; and a second sensor for detecting the vibration state of said second vibration element.

9. A sheet feeding device according to claim 8, further comprising:

first driving signal supply means for applying electrical signals of mutually different phases respectively to said first and second electromechanical energy converting elements; and second driving signal supply means for applying electrical signals of mutually different phases respectively to said third and fourth electromechanical energy converting elements.

10. A sheet feeding device according to claim 9, further comprising:

detecting means for detecting the phase difference between the output signals from said first and second sensors; and means for adjusting the phases of the signals released from said first driving signal supply means and those of the signals released from said second driving signal supply means according to an electrical signal corresponding to the predetermined sheet feeding speed and an output signal from said detecting means.

11. A sheet feeding device comprising:

(a) a vibration member for generating a travelling vibration wave to feed a sheet member, said vibration member having first and second vibration elements provided in positions for pinching said sheet member; and (b) means for varying the phase difference between the vibration wave generated in the first vibration element and that in the second vibration element in accordance with a change in the feeding speed of said sheet member.

12. A sheet feeding device according to claim 11, wherein said first vibration element comprises:

first and second electromechanical energy converting elements provided in spatially different positions; and a first sensor for detecting the vibration state of said first vibration element.

13. A sheet feeding device according to claim 12, wherein said second vibration element comprises:

third and fourth electromechanical energy converting elements provided in spatially different positions; and a second sensor for detecting the vibration state of said second vibration element.

14. A sheet feeding device according to claim 13, further comprising:

first driving signal supply means for applying electrical signals of mutually different phase respectively to said first and second electromechanical energy converting elements; and second driving signal supply means for applying electrical signals of mutually different phase respectively to said third and fourth electromechanical energy converting elements.

15. A sheet feeding device according to claim 14, further comprising:

detecting means for detecting the phase difference between the output signals from said first and second sensors; and means for adjusting the phase of the signals from said first driving signal supply means and said second driving signal supply means in accordance with an electrical signal corresponding to the predetermined sheet feeding speed and an output signal from said detecting means.

16. A sheet feeding device according to claim 11, wherein each of said first and second vibration elements includes an oval-shaped vibration element.

17. A sheet feeding device according to claim 16, wherein each of said first and second vibration elements includes a straight part frictionally engaged with the sheet member in order to feed said sheet member.

* * * * *

UNITED STATES PATENT AND TRADEMARK OFFICE

CERTIFICATE OF CORRECTION

PATENT NO. : 5,062,622

DATED : November 5, 1991

INVENTOR(S) : Kenichi Kataoka et al.

It is certified that error appears in the above-identified patent and that said Letters Patent is hereby corrected as shown below: On the title page

UNDER "ATTORNEY, AGENT OR FIRM" HEADING:

"Fitzpartick" should read -- Fitzpatrick --.

IN FIGURE 9:

"SEET" should read -- SHEET --.

COLUMN 1:

Line 18, "member" should read -- members --; and
Line 27, "element" should read -- elements --.

COLUMN 5:

Line 61, "Embodiment," should read
-- Embodiment) --.

COLUMN 6:

Line 49, "assume at" should read -- assume the
illustrated state when said switching signal is at --.

COLUMN 8:

Line 1, "shifts" should read -- shift --; and
Line 30, "monotonously" should read -- linearly --.

UNITED STATES PATENT AND TRADEMARK OFFICE

CERTIFICATE OF CORRECTION

PATENT NO. : 5,062,622

DATED : November 5, 1991

INVENTOR(S) : Kenichi Kataoka et al.

It is certified that error appears in the above-identified patent and that said Letters Patent is hereby corrected as shown below:

COLUMN 9:

Line 14, "samples" should read -- the same --; and
Line 32, "vibrations" should read -- vibration --.

COLUMN 10:

Line 6, "speed for example" should read -- speed, for example, --.

COLUMN 11:

Line 8, "include" should read -- includes --; and
Line 9, "claim 3," should read -- claim 5, --.

Signed and Sealed this

Twentieth Day of April, 1993

*Attest:*

*Attesting Officer*

MICHAEL K. KIRK

*Acting Commissioner of Patents and Trademarks*